US011391300B2

(12) United States Patent
Kallas et al.

(10) Patent No.: US 11,391,300 B2
(45) Date of Patent: Jul. 19, 2022

(54) EXTERNALLY REGULATED CONTROL FOR DRIVE PUMP

(71) Applicant: Clark Equipment Company, West Fargo, ND (US)

(72) Inventors: Douglas Kallas, Mandan, ND (US); Charles Young, Bismarck, ND (US); Sloan Balo, Bismarck, ND (US)

(73) Assignee: CLARK EQUIPMENT COMPANY, West Fargo, ND (US)

( * ) Notice: Subject to any disclaimer, the term of this patent is extended or adjusted under 35 U.S.C. 154(b) by 0 days.

(21) Appl. No.: 17/129,105

(22) Filed: Dec. 21, 2020

(65) Prior Publication Data

US 2021/0190096 A1 Jun. 24, 2021

Related U.S. Application Data

(60) Provisional application No. 62/951,131, filed on Dec. 20, 2019.

(51) Int. Cl.
*F15B 7/00* (2006.01)

(52) U.S. Cl.
CPC ..... *F15B 7/008* (2013.01)

(58) Field of Classification Search
CPC ..... F15B 7/008; F16H 39/42; F16H 39/04; F16H 2039/0005; F16H 57/0434; F16H 61/4139; F16H 39/00; E02F 9/2292; E02F 9/2296; E02F 9/2253; E02F 2039/005
USPC ..... 60/327
See application file for complete search history.

(56) References Cited

U.S. PATENT DOCUMENTS

| | | | | |
|---|---|---|---|---|
| 3,947,194 | A | 3/1976 | Schlecht | |
| 3,964,262 | A | 6/1976 | Patton | |
| 4,399,886 | A | 8/1983 | Pollman | |
| 4,401,182 | A | 8/1983 | Pollman | |
| 5,173,031 | A | 12/1992 | Nonnenmacher | |
| 6,360,537 | B1 * | 3/2002 | Widemann | F16H 61/4035 60/451 |
| 8,006,491 | B2 | 8/2011 | Narazaki | |
| 8,051,764 | B2 | 11/2011 | Jacobsen | |
| 9,746,005 | B2 | 8/2017 | Kadlicko | |
| 10,060,450 | B2 | 8/2018 | Udagawa | |
| 2008/0238187 | A1 | 10/2008 | Garnett | |
| 2009/0126361 | A1 * | 5/2009 | Kakizawa | E02F 9/2296 60/445 |
| 2011/0308878 | A1 | 12/2011 | Shirao | |
| 2016/0341308 | A1 | 11/2016 | Rathke | |

FOREIGN PATENT DOCUMENTS

EP 2466018 A1 6/2012

OTHER PUBLICATIONS

International Searching Authority. International Search Report and Written Opinion for application PCT/US2020/066395, dated May 19, 2021. 17 pages.

* cited by examiner

*Primary Examiner* — Michael Leslie
*Assistant Examiner* — Daniel S Collins

(57) ABSTRACT

A control system is provided for a power machine that includes a hydraulic charge circuit with a hydraulic charge pump, and a variable displacement drive pump. A signal for control of displacement of the drive pump can be diverted from the hydraulic charge circuit downstream from the pump, including via a flow path that branches from the hydraulic charge circuit from a location upstream of a hydraulic load.

20 Claims, 6 Drawing Sheets

EXTERNALLY REGULATED CONTROL FOR DRIVE PUMP

CROSS-REFERENCE TO RELATED APPLICATIONS

This application claims priority to U.S. provisional patent application No. 62/951,131, filed Dec. 20, 2019, the entirety of which is incorporated herein by reference.

BACKGROUND

This disclosure is directed toward power machines. More particularly, this disclosure is directed toward a drive system of a power machine and control of a hydrostatic drive system. Power machines, for the purposes of this disclosure, include any type of machine that generates power to accomplish a particular task or a variety of tasks. One type of power machine is a work vehicle. Work vehicles are generally self-propelled vehicles that have a work device, such as a lift arm (although some work vehicles can have other work devices) that can be manipulated to perform a work function. Work vehicles include loaders, excavators, utility vehicles, tractors, and trenchers, to name a few examples.

Some power machines can convert power from a power source (e.g., an engine) into a form that can be used by a hydraulic drive system to move the machine (i.e., for traction control) or to operate work implements, such as a lift arm. For example, certain power machines can include a hydrostatic drive system in which one or more hydrostatic drive pumps selectively provide pressurized hydraulic fluid to one or more drive motors for moving the power machine over a support surface (e.g. ground). The drive pumps can be variable displacement pumps that are controlled by one or more control valves. One or more hydraulic charge pumps can be configured to charge the hydrostatic drive system, i.e., providing flow to replace leakage that typically occurs in components in a hydrostatic circuit or otherwise supplement a supply of hydraulic fluid in the hydrostatic drive system.

The discussion above is merely provided for general background information and is not intended to be used as an aid in determining the scope of the claimed subject matter.

SUMMARY

Some embodiments disclosed herein can include systems and related methods for improving operation of hydraulic drive systems, including through improved routing of control signals for variable displacement drive pumps.

Some of the disclosed embodiments provide a hydraulic charge circuit for providing pressurized hydraulic flow to a hydrostatic drive system for a power machine, the hydrostatic drive system including a hydrostatic drive circuit having a variable displacement drive pump operably coupled to a hydrostatic drive motor, and a control assembly configured to control displacement of the variable displacement drive pump. The hydraulic charge circuit can include a hydraulic charge pump, a supply hydraulic flow path, and a control flow path. The supply hydraulic flow path can extend from the hydraulic charge pump to a pressure relief valve that sets a hydraulic pressure for a charge flow of hydraulic fluid to be supplied to the hydrostatic circuit by the hydraulic charge pump. The control flow path can branch from the supply hydraulic flow path upstream of the pressure relief valve, and can be configured to provide a pressurized hydraulic control signal to the control assembly.

Some of the disclosed embodiments provide a power machine. A hydrostatic drive system of the power machine can have a variable displacement drive pump in communication with a hydrostatic drive motor via a hydrostatic drive circuit. A hydraulic charge circuit of the power machine can include a hydraulic charge pump that is configured to provide a hydraulic charge flow to the hydrostatic drive circuit via a hydraulic charge flow path. A control system of the power machine can include an actuator configured to control displacement of the variable displacement drive pump, a valve assembly configured to control the actuator, and one or more pilot supply valves. The one or more pilot supply valves can be configured to control hydraulic flow from the hydraulic charge pump to the valve assembly along one or more control flow paths that are separate from the hydraulic charge flow path.

Some of the disclosed embodiments provide a method of operating a hydrostatic drive circuit of a power machine. A hydraulic charge pump can be operated to provide a hydraulic flow along a supply hydraulic flow path of a hydraulic charge circuit. The hydraulic flow can be divided, within the hydraulic charge circuit, between a hydraulic charge flow path and a control flow path that branches from the supply hydraulic flow path downstream of the hydraulic charge pump and upstream of a hydraulic load included in the hydraulic charge circuit. The control flow path can provide a first flow to a control assembly that is configured to control the displacement of a variable displacement drive pump of the hydrostatic drive circuit. The hydraulic charge flow path can provide a second flow to charge the hydrostatic drive circuit.

This Summary and the Abstract are provided to introduce a selection of concepts in a simplified form that are further described below in the Detailed Description. This Summary is not intended to identify key features or essential features of the claimed subject matter, nor are they intended to be used as an aid in determining the scope of the claimed subject matter.

DRAWINGS

DETAILED DESCRIPTION

Figure 1:
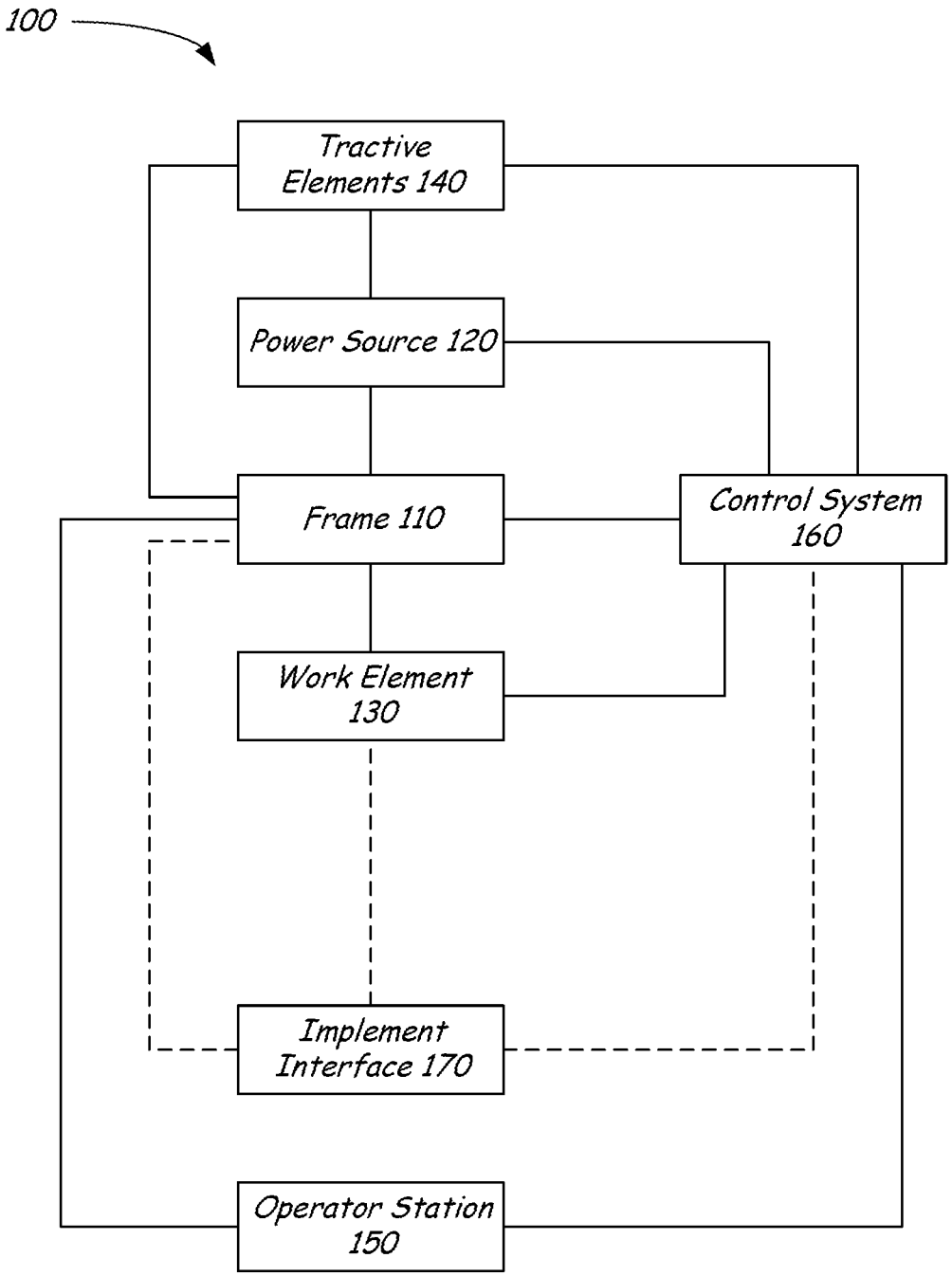
FIG. 1 is a block diagram illustrating functional systems of a representative power machine on which embodiments of the present disclosure can be advantageously practiced.

The concepts disclosed in this discussion are described and illustrated by referring to exemplary embodiments. These concepts, however, are not limited in their application to the details of construction and the arrangement of components in the illustrative embodiments and are capable of being practiced or being carried out in various other ways. The terminology in this document is used for the purpose of description and should not be regarded as limiting. Words such as "including," "comprising," and "having" and variations thereof as used herein are meant to encompass the items listed thereafter, equivalents thereof, as well as additional items.

In some configurations of power machines, hydrostatic drive systems can provide power to tractive elements, in order to move the power machines over terrain. For example, a variable displacement drive pump can be arranged to provide hydraulic flow to a hydraulic drive motor via a hydrostatic drive circuit. A control assembly, that in some embodiments includes a valve that provides pilot pressure to control a swash plate actuator, for example a servo valve and actuator combination (other combinations besides the servo valve and actuator combination can be employed), can be provided to control the displacement of the drive pump and thereby control hydraulic flow to the drive motor.

Although hydrostatic drive circuits can provide efficient and effective delivery of tractive power, typical systems experience regular leakage of hydraulic fluid. Leakage from the hydrostatic drive circuit can be important, because it can provide a path for oil to leave the hydrostatic circuit, to be provided to an oil cooling circuit to maintain an acceptable temperature in the hydrostatic circuit. Many such systems also have a flushing valve to evacuate a given amount of hydraulic fluid from the circuit, with this fluid being directed to a heat exchanger for the purposes of cooling the hydraulic fluid. However, due to this constant removal of fluid from the hydrostatic drive circuit, pressurized hydraulic fluid needs to be continuously provided back into the hydrostatic circuit to replenish the hydrostatic drive circuit. Accordingly, a hydraulic charge pump (e.g., that is directly driven by an engine of a power machine) can be used to provide this make up oil to (i.e., to replenish) the hydrostatic drive circuit. The hydraulic charge circuit can further include a charge pressure relief valve (often located with a drive pump assembly) that sets pressure at which the hydraulic fluid is provided to the drive circuit. Thus, hydraulic flow can be provided to a hydrostatic drive circuit at a predetermined pressure to replace hydraulic leakage and ensure that an associated drive pump is appropriately primed.

In conventional arrangements, a hydraulic charge pump for a hydraulic charge circuit can be used for other purposes than simply to charge a hydrostatic drive circuit. For example, pressurized flow from the hydraulic charge circuit can be provided to a control valve on the one or more drive pumps (e.g., a servo control valve, as is well known in the art) to control of the displacement of an associated drive pump. Using a hydraulic charge pump to perform both of these functions can provide some efficiencies for a power machine. Notably, different pumps are not required to perform both of these functions, which provides cost and space benefits, and a reduced overall complexity of the machine.

Although the use of a hydraulic charge pump for multiple purposes can provide certain efficiencies for a power machine, some conventional arrangements may not be optimally arranged. For example, typical servo control valve assemblies use low flow rate, relatively high pressure signals to shift a servo control valve, whereas drive circuits can be efficiently charged using a relatively higher flow rate, relatively lower pressure flow (as compared to the pressure signal provided to the servo control assemblies). Thus, these two purposes require signals that conflict with each other. With conventional systems that rely on a common pressure setting device (such as a pressure relief valve) to set the pressure for both of these functions, systems can only be optimized for one of these functions or can instead select a pressure that is optimized for neither function.

In some embodiments, to address the issues noted above (or others), a second pressure setting device can be introduced into a system to provide a first path configured to provide high pressure flow to the servo control valves and a second path configured to provide low pressure flow to the hydrostatic drive circuit. Thus, using a single pump, a low volume, high pressure flow can be provided for control of the servo control valves and a high volume, low pressure flow can be provided to charge an associated hydrostatic drive circuit. Advantageously, the pressure provided to the servo control valves can be sufficiently large to control the spools and the pressure provided to the hydraulic drive circuit can be set at a lower level to improve the efficiency of the overall system.

Figure 2:
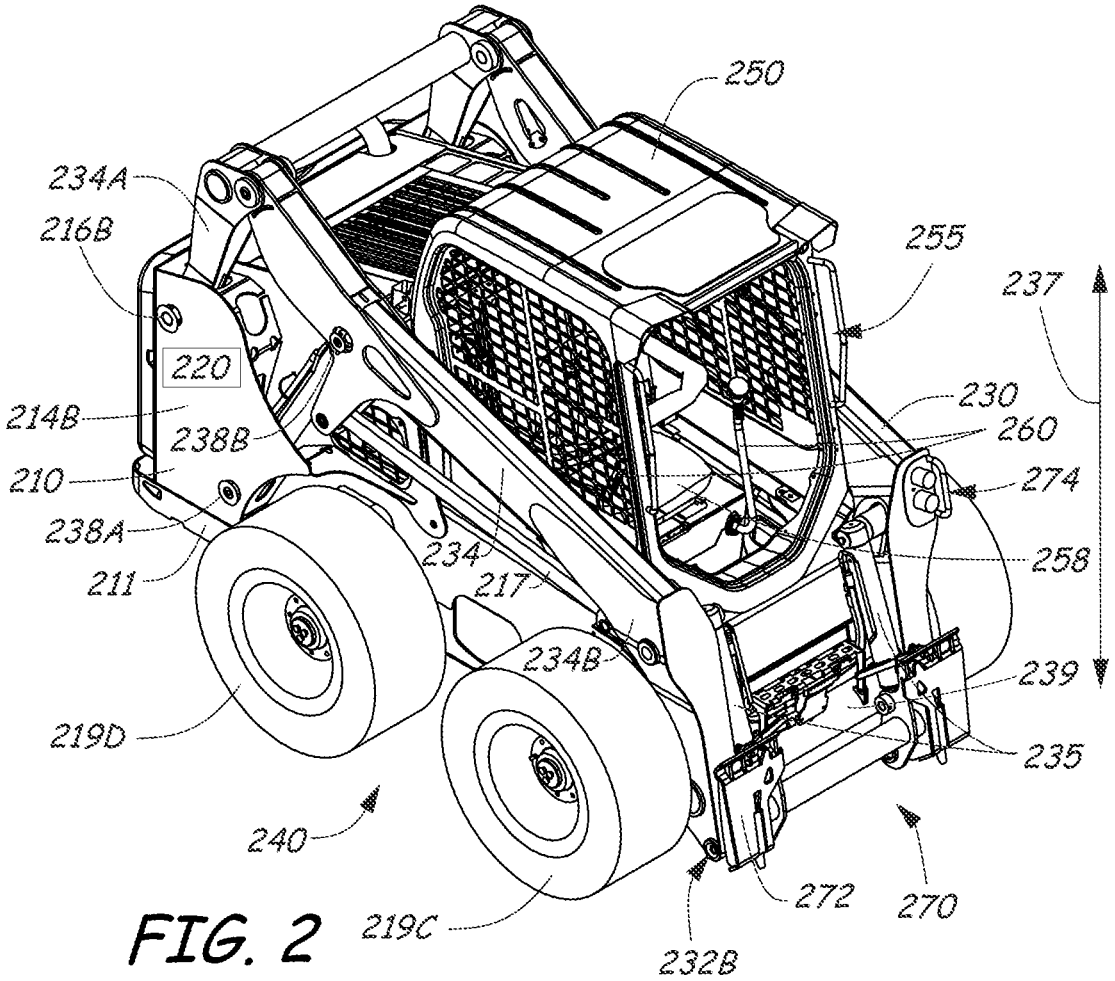
FIGS. 2-3 illustrate perspective views of a representative power machine in the form of a skid-steer loader of the type on which the disclosed embodiments can be practiced.
Figure 3:
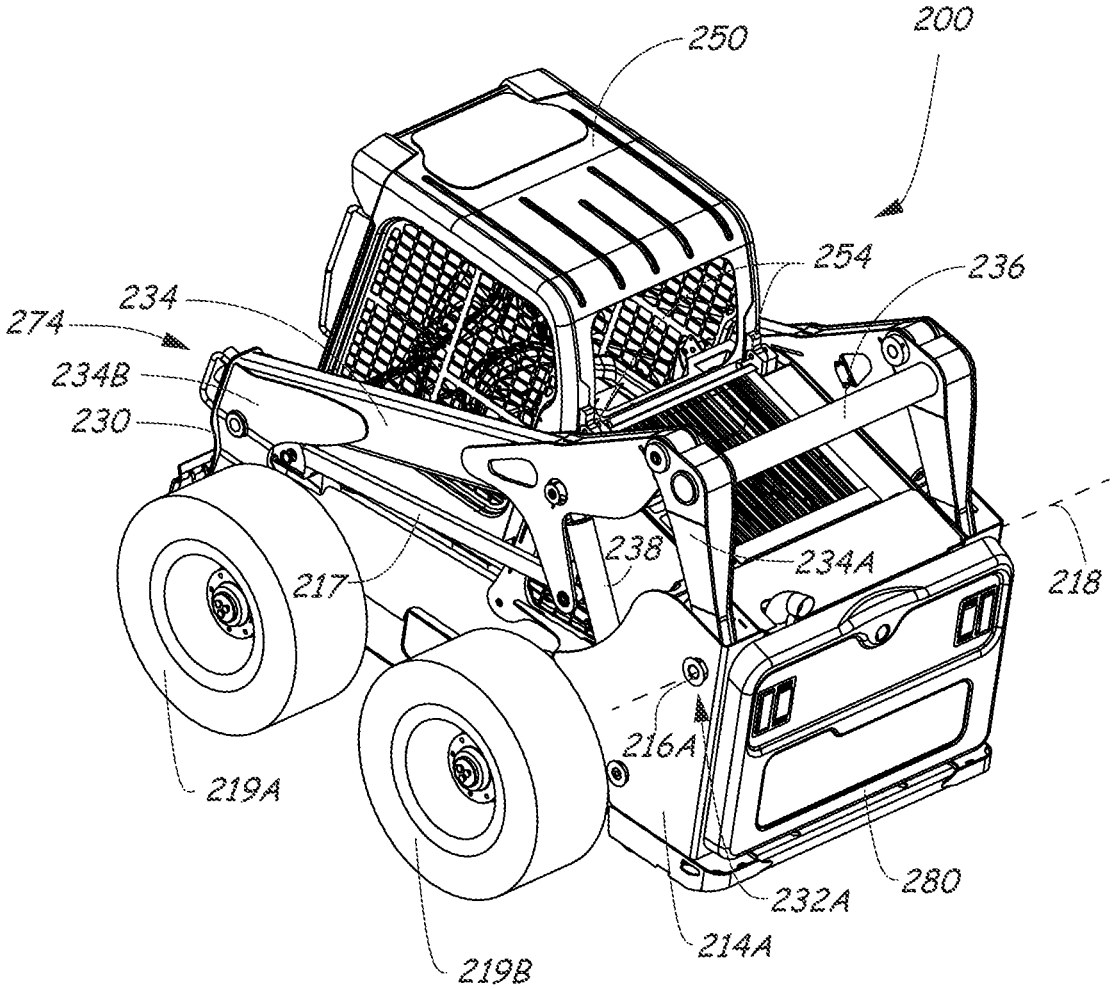

These concepts can be practiced on various power machines, as will be described below. A representative power machine on which the embodiments can be practiced is illustrated in diagram form in FIG. 1 and one example of such a power machine is illustrated in FIGS. 2-3 and described below before any embodiments are disclosed. For the sake of brevity, only one power machine is illustrated and discussed as being a representative power machine. However, as mentioned above, the embodiments below can be practiced on any of a number of power machines, including power machines of different types from the representative power machine shown in FIGS. 2-3. Power machines, for the purposes of this discussion, include a frame, at least one work element, and a power source that can provide power to the work element to accomplish a work task. One type of power machine is a self-propelled work vehicle. Self-propelled work vehicles are a class of power machines that include a frame, work element, and a power source that can provide power to the work element. At least one of the work elements is a motive system for moving the power machine under power.

FIG. 1 is a block diagram that illustrates the basic systems of a power machine 100, which can be any of a number of different types of power machines, upon which the embodiments discussed below can be advantageously incorporated. The block diagram of FIG. 1 identifies various systems on power machine 100 and the relationship between various components and systems. As mentioned above, at the most basic level, power machines for the purposes of this discussion include a frame, a power source, and a work element. The power machine 100 has a frame 110, a power source 120, and a work element 130. Because power machine 100 shown in FIG. 1 is a self-propelled work vehicle, it also has tractive elements 140, which are themselves work elements provided to move the power machine over a support surface and an operator station 150 that provides an operating position for controlling the work elements of the power machine. A control system 160 is provided to interact with the other systems to perform various work tasks at least in part in response to control signals provided by an operator.

Certain work vehicles have work elements that can perform a dedicated task. For example, some work vehicles have a lift arm to which an implement such as a bucket is attached such as by a pinning arrangement. The work element, i.e., the lift arm can be manipulated to position the implement to perform the task. The implement, in some instances can be positioned relative to the work element, such as by rotating a bucket relative to a lift arm, to further position the implement. Under normal operation of such a work vehicle, the bucket is intended to be attached and under use. Such work vehicles may be able to accept other implements by disassembling the implement/work element combination and reassembling another implement in place of the original bucket. Other work vehicles, however, are intended to be used with a wide variety of implements and have an implement interface such as implement interface 170 shown in FIG. 1. At its most basic, implement interface 170 is a connection mechanism between the frame 110 or a work element 130 and an implement, which can be as simple as a connection point for attaching an implement directly to the frame 110 or a work element 130 or more complex, as discussed below.

On some power machines, implement interface 170 can include an implement carrier, which is a physical structure movably attached to a work element. The implement carrier has engagement features and locking features to accept and secure any of a number of different implements to the work element. One characteristic of such an implement carrier is that once an implement is attached to it, it is fixed to the implement (i.e. not movable with respect to the implement) and when the implement carrier is moved with respect to the work element, the implement moves with the implement carrier. The term implement carrier as used herein is not merely a pivotal connection point, but rather a dedicated device specifically intended to accept and be secured to various different implements. The implement carrier itself is mountable to a work element 130 such as a lift arm or the frame 110. Implement interface 170 can also include one or more power sources for providing power to one or more work elements on an implement. Some power machines can have a plurality of work element with implement interfaces, each of which may, but need not, have an implement carrier for receiving implements. Some other power machines can have a work element with a plurality of implement interfaces so that a single work element can accept a plurality of implements simultaneously. Each of these implement interfaces can, but need not, have an implement carrier.

Frame 110 includes a physical structure that can support various other components that are attached thereto or positioned thereon. The frame 110 can include any number of individual components. Some power machines have frames that are rigid. That is, no part of the frame is movable with respect to another part of the frame. Other power machines have at least one portion that can move with respect to another portion of the frame. For example, excavators can have an upper frame portion that rotates with respect to a lower frame portion. Other work vehicles have articulated frames such that one portion of the frame pivots with respect to another portion for accomplishing steering functions.

Frame 110 supports the power source 120, which is configured to provide power to one or more work elements 130 including the one or more tractive elements 140, as well as, in some instances, providing power for use by an attached implement via implement interface 170. Power from the power source 120 can be provided directly to any of the work elements 130, tractive elements 140, and implement interfaces 170. Alternatively, power from the power source 120 can be provided to a control system 160, which in turn selectively provides power to the elements that capable of using it to perform a work function. Power sources for power machines typically include an engine such as an internal combustion engine and a power conversion system such as a mechanical transmission or a hydraulic system that is configured to convert the output from an engine into a form of power that is usable by a work element. Other types of power sources can be incorporated into power machines, including electrical sources or a combination of power sources, known generally as hybrid power sources.

FIG. 1 shows a single work element designated as work element 130, but various power machines can have any number of work elements. Work elements are typically attached to the frame of the power machine and movable with respect to the frame when performing a work task. In addition, tractive elements 140 are a special case of work element in that their work function is generally to move the power machine 100 over a support surface. Tractive elements 140 are shown separate from the work element 130 because many power machines have additional work elements besides tractive elements, although that is not always the case. Power machines can have any number of tractive elements, some or all of which can receive power from the power source 120 to propel the power machine 100. Tractive elements can be, for example, track assemblies, wheels attached to an axle, and the like. Tractive elements can be mounted to the frame such that movement of the tractive element is limited to rotation about an axle (so that steering is accomplished by a skidding action) or, alternatively, pivotally mounted to the frame to accomplish steering by pivoting the tractive element with respect to the frame.

Power machine 100 includes an operator station 150 that includes an operating position from which an operator can control operation of the power machine. In some power machines, the operator station 150 is defined by an enclosed or partially enclosed cab. Some power machines on which the disclosed embodiments may be practiced may not have a cab or an operator compartment of the type described above. For example, a walk behind loader may not have a cab or an operator compartment, but rather an operating position that serves as an operator station from which the power machine is properly operated. More broadly, power machines other than work vehicles may have operator stations that are not necessarily similar to the operating positions and operator compartments referenced above. Further, some power machines such as power machine 100 and others, whether or not they have operator compartments or operator positions, may be capable of being operated remotely (i.e. from a remotely located operator station) instead of or in addition to an operator station adjacent or on the power machine. This can include applications where at least some of the operator-controlled functions of the power machine can be operated from an operating position associated with an implement that is coupled to the power machine. Alternatively, with some power machines, a remote-control device can be provided (i.e. remote from both the power machine and any implement to which it is coupled) that is capable of controlling at least some of the operator-controlled functions on the power machine.

FIGS. 2-3 illustrate a loader 200, which is one particular example of a power machine of the type illustrated in FIG. 1 where the embodiments discussed below can be advantageously employed. Loader 200 is a skid-steer loader, which is a loader that has tractive elements (in this case, four wheels) that are mounted to the frame of the loader via rigid axles. Here the phrase "rigid axles" refers to the fact that the skid-steer loader 200 does not have any tractive elements that can be rotated or steered to help the loader accomplish a turn. Instead, a skid-steer loader has a drive system that independently powers one or more tractive elements on each side of the loader so that by providing differing tractive signals to each side, the machine will tend to skid over a support surface. These varying signals can even include powering tractive element(s) on one side of the loader to move the loader in a forward direction and powering tractive element(s) on another side of the loader to mode the loader in a reverse direction so that the loader will turn about a radius centered within the footprint of the loader itself. The term "skid-steer" has traditionally referred to loaders that have skid steering as described above with wheels as tractive elements. However, it should be noted that many track loaders also accomplish turns via skidding and are technically skid-steer loaders, even though they do not have wheels. For the purposes of this discussion, unless noted otherwise, the term skid-steer should not be seen as limiting the scope of the discussion to those loaders with wheels as tractive elements.

Loader 200 is one particular example of the power machine 100 illustrated broadly in FIG. 1 and discussed above. To that end, features of loader 200 described below include reference numbers that are generally similar to those used in FIG. 1. For example, loader 200 is described as having a frame 210, just as power machine 100 has a frame 110. Skid-steer loader 200 is described herein to provide a reference for understanding one environment on which the embodiments described below related to track assemblies and mounting elements for mounting the track assemblies to a power machine may be practiced. The loader 200 should not be considered limiting especially as to the description of features that loader 200 may have described herein that are not essential to the disclosed embodiments and thus may or may not be included in power machines other than loader 200 upon which the embodiments disclosed below may be advantageously practiced. Unless specifically noted otherwise, embodiments disclosed below can be practiced on a variety of power machines, with the loader 200 being only one of those power machines. For example, some or all of the concepts discussed below can be practiced on many other types of work vehicles such as various other loaders, excavators, trenchers, and dozers, to name but a few examples.

Loader 200 includes frame 210 that supports a power system 220, the power system being capable of generating or otherwise providing power for operating various functions on the power machine. Power system 220 is shown in block diagram form but is located within the frame 210. Frame 210 also supports a work element in the form of a lift arm assembly 230 that is powered by the power system 220 and that can perform various work tasks. As loader 200 is a work vehicle, frame 210 also supports a traction system 240, which is also powered by power system 220 and can propel the power machine over a support surface. The lift arm assembly 230 in turn supports an implement interface 270, which includes an implement carrier 272 that can receive and secure various implements to the loader 200 for performing various work tasks and power couplers 274, to which an implement can be coupled for selectively providing power to an implement that might be connected to the loader. Power couplers 274 can provide sources of hydraulic or electric power or both. The loader 200 includes a cab 250 that defines an operator station 255 from which an operator can manipulate various control devices 260 to cause the power machine to perform various work functions. Cab 250 can be pivoted back about an axis that extends through mounts 254 to provide access to power system components as needed for maintenance and repair.

The operator station 255 includes an operator seat 258 and a plurality of operation input devices, including control levers 260 that an operator can manipulate to control various machine functions. Operator input devices can include buttons, switches, levers, sliders, pedals and the like that can be stand-alone devices such as hand operated levers or foot pedals or incorporated into hand grips or display panels, including programmable input devices. Actuation of operator input devices can generate signals in the form of electrical signals, hydraulic signals, and/or mechanical signals. Signals generated in response to operator input devices are provided to various components on the power machine for controlling various functions on the power machine. Among the functions that are controlled via operator input devices on power machine 100 include control of the tractive elements 219, the lift arm assembly 230, the implement carrier 272, and providing signals to any implement that may be operably coupled to the implement.

Loaders can include human-machine interfaces including display devices that are provided in the cab 250 to give indications of information relatable to the operation of the power machines in a form that can be sensed by an operator, such as, for example audible and/or visual indications. Audible indications can be made in the form of buzzers, bells, and the like or via verbal communication. Visual indications can be made in the form of graphs, lights, icons, gauges, alphanumeric characters, and the like. Displays can be dedicated to providing dedicated indications, such as warning lights or gauges, or dynamic to provide programmable information, including programmable display devices such as monitors of various sizes and capabilities. Display devices can provide diagnostic information, troubleshooting information, instructional information, and various other types of information that assists an operator with operation of the power machine or an implement coupled to the power machine. Other information that may be useful for an operator can also be provided. Other power machines, such walk behind loaders may not have a cab nor an operator compartment, nor a seat. The operator position on such loaders is generally defined relative to a position where an operator is best suited to manipulate operator input devices.

Various power machines that can include and/or interacting with the embodiments discussed below can have various different frame components that support various work elements. The elements of frame 210 discussed herein are provided for illustrative purposes and frame 210 is not the only type of frame that a power machine on which the embodiments can be practiced can employ. Frame 210 of loader 200 includes an undercarriage or lower portion 211 of the frame and a mainframe or upper portion 212 of the frame that is supported by the undercarriage. The mainframe 212 of loader 200, in some embodiments is attached to the undercarriage 211 such as with fasteners or by welding the undercarriage to the mainframe. Alternatively, the mainframe and undercarriage can be integrally formed. Mainframe 212 includes a pair of upright portions 214A and 214B located on either side and toward the rear of the mainframe that support lift arm assembly 230 and to which the lift arm assembly 230 is pivotally attached. The lift arm assembly 230 is illustratively pinned to each of the upright portions 214A and 214B. The combination of mounting features on the upright portions 214A and 214B and the lift arm assembly 230 and mounting hardware (including pins used to pin the lift arm assembly to the mainframe 212) are collectively referred to as joints 216A and 216B (one is located on each of the upright portions 214) for the purposes of this discussion. Joints 216A and 216B are aligned along an axis 218 so that the lift arm assembly is capable of pivoting, as discussed below, with respect to the frame 210 about axis 218. Other power machines may not include upright portions on either side of the frame or may not have a lift arm assembly that is mountable to upright portions on either side and toward the rear of the frame. For example, some power machines may have a single arm, mounted to a single side of the power machine or to a front or rear end of the power machine. Other machines can have a plurality of work elements, including a plurality of lift arms, each of which is mounted to the machine in its own configuration. Frame 210 also supports a pair of tractive elements in the form of wheels 219A-D on either side of the loader 200.

The lift arm assembly 230 shown in FIGS. 2-3 is one example of many different types of lift arm assemblies that can be attached to a power machine such as loader 200 or other power machines on which embodiments of the present discussion can be practiced. The lift arm assembly 230 is what is known as a vertical lift arm, meaning that the lift arm assembly 230 is moveable (i.e. the lift arm assembly can be raised and lowered) under control of the loader 200 with respect to the frame 210 along a lift path 237 that forms a generally vertical path. Other lift arm assemblies can have different geometries and can be coupled to the frame of a loader in various ways to provide lift paths that differ from the radial path of lift arm assembly 230. For example, some lift paths on other loaders provide a radial lift path. Other lift arm assemblies can have an extendable or telescoping portion. Other power machines can have a plurality of lift arm assemblies attached to their frames, with each lift arm assembly being independent of the other(s). Unless specifically stated otherwise, none of the inventive concepts set forth in this discussion are limited by the type or number of lift arm assemblies that are coupled to a particular power machine.

The lift arm assembly 230 has a pair of lift arms 234 that are disposed on opposing sides of the frame 210. A first end of each of the lift arms 234 is pivotally coupled to the power machine at joints 216 and a second end 232B of each of the lift arms is positioned forward of the frame 210 when in a lowered position as shown in FIG. 2. Joints 216 are located toward a rear of the loader 200 so that the lift arms extend along the sides of the frame 210. The lift path 237 is defined by the path of travel of the second end 232B of the lift arms 234 as the lift arm assembly 230 is moved between a minimum and maximum height.

Each of the lift arms 234 has a first portion 234A of each lift arm 234 is pivotally coupled to the frame 210 at one of the joints 216 and the second portion 234B extends from its connection to the first portion 234A to the second end 232B of the lift arm assembly 230. The lift arms 234 are each coupled to a cross member 236 that is attached to the first portions 234A. Cross member 236 provides increased structural stability to the lift arm assembly 230. A pair of actuators 238, which on loader 200 are hydraulic cylinders configured to receive pressurized fluid from power system 220, are pivotally coupled to both the frame 210 and the lift arms 234 at pivotable joints 238A and 238B, respectively, on either side of the loader 200. The actuators 238 are sometimes referred to individually and collectively as lift cylinders. Actuation (i.e., extension and retraction) of the actuators 238 cause the lift arm assembly 230 to pivot about joints 216 and thereby be raised and lowered along a fixed path illustrated by arrow 237. Each of a pair of control links 217 are pivotally mounted to the frame 210 and one of the lift arms 232 on either side of the frame 210. The control links 217 help to define the fixed lift path of the lift arm assembly 230.

Some lift arms, most notably lift arms on excavators but also possible on loaders, may have portions that are controllable to pivot with respect to another segment instead of moving in concert (i.e. along a pre-determined path) as is the case in the lift arm assembly 230 shown in FIG. 2. Some power machines have lift arm assemblies with a single lift arm, such as is known in excavators or even some loaders and other power machines. Other power machines can have a plurality of lift arm assemblies, each being independent of the other(s).

An implement interface 270 is provided proximal to a second end 232B of the lift arm assembly 234. The implement interface 270 includes an implement carrier 272 that is capable of accepting and securing a variety of different implements to the lift arm 230. Such implements have a complementary machine interface that is configured to be engaged with the implement carrier 272. The implement carrier 272 is pivotally mounted at the second end 232B of the arm 234. Implement carrier actuators 235 are operably coupled the lift arm assembly 230 and the implement carrier 272 and are operable to rotate the implement carrier with respect to the lift arm assembly. Implement carrier actuators 235 are illustratively hydraulic cylinders and often known as tilt cylinders.

By having an implement carrier capable of being attached to a plurality of different implements, changing from one implement to another can be accomplished with relative ease. For example, machines with implement carriers can provide an actuator between the implement carrier and the lift arm assembly, so that removing or attaching an implement does not involve removing or attaching an actuator from the implement or removing or attaching the implement from the lift arm assembly. The implement carrier 272 provides a mounting structure for easily attaching an implement to the lift arm (or other portion of a power machine) that a lift arm assembly without an implement carrier does not have.

Some power machines can have implements or implement like devices attached to it such as by being pinned to a lift arm with a tilt actuator also coupled directly to the implement or implement type structure. A common example of such an implement that is rotatably pinned to a lift arm is a bucket, with one or more tilt cylinders being attached to a bracket that is fixed directly onto the bucket such as by welding or with fasteners. Such a power machine does not have an implement carrier, but rather has a direct connection between a lift arm and an implement.

The implement interface 270 also includes an implement power source 274 available for connection to an implement on the lift arm assembly 230. The implement power source 274 includes pressurized hydraulic fluid port to which an implement can be removably coupled. The pressurized hydraulic fluid port selectively provides pressurized hydraulic fluid for powering one or more functions or actuators on an implement. The implement power source can also include an electrical power source for powering electrical actuators and/or an electronic controller on an implement. The implement power source 274 also exemplarily includes electrical conduits that are in communication with a data bus on the excavator 200 to allow communication between a controller on an implement and electronic devices on the loader 200.

Figure 4:
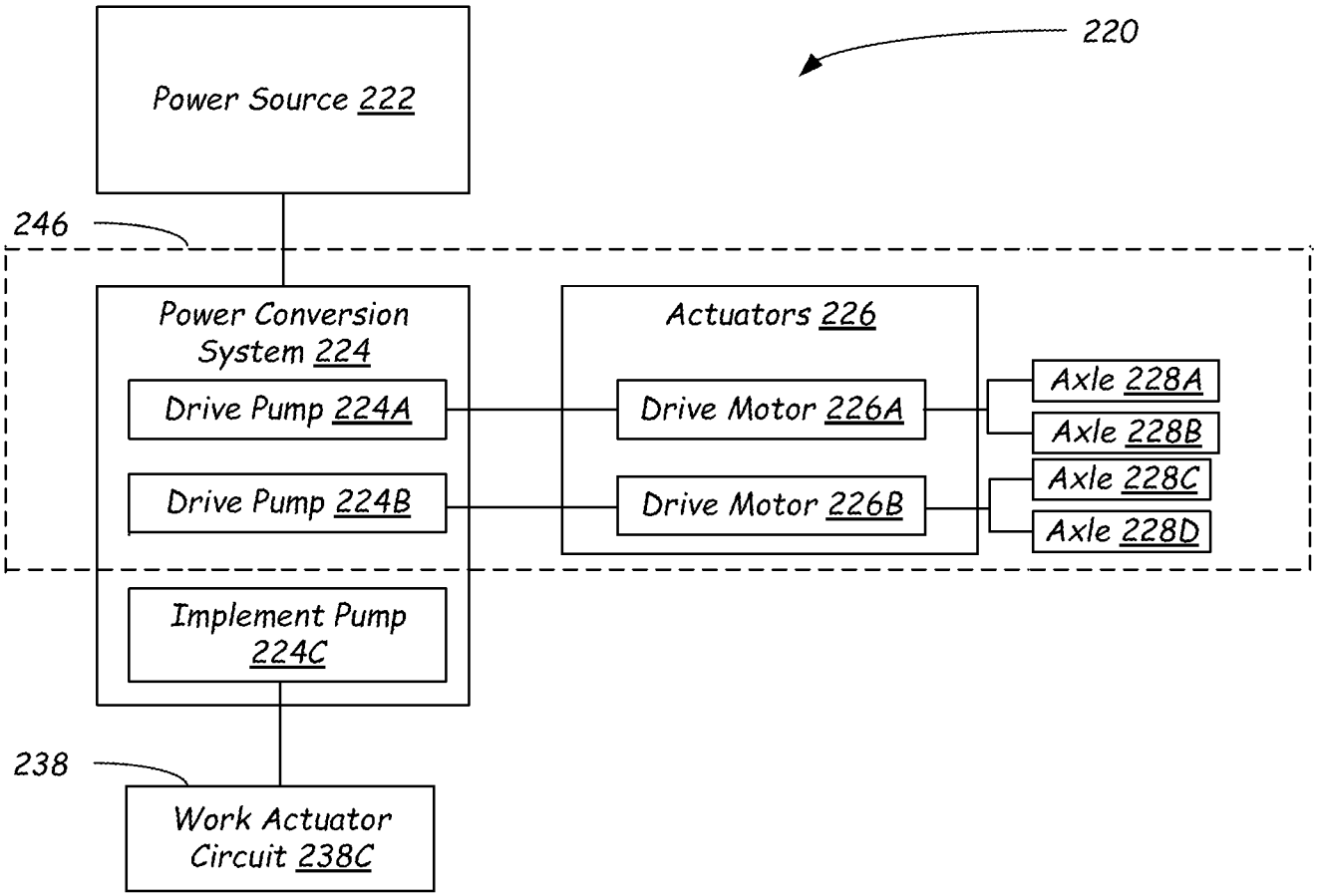
FIG. 4 is a block diagram illustrating components of a power system of a loader such as the loader illustrated in FIGS. 2-3.

Frame 210 supports and generally encloses the power system 220 so that the various components of the power system 220 are not visible in FIGS. 2-3. FIG. 4 includes, among other things, a diagram of various components of the power system 220. Power system 220 includes one or more power sources 222 that are capable of generating and/or storing power for use on various machine functions. On power machine 200, the power system 220 includes an internal combustion engine. Other power machines can include electric generators, rechargeable batteries, various other power sources or any combination of power sources that can provide power for given power machine components. The power system 220 also includes a power conversion system 224, which is operably coupled to the power source 222. Power conversion system 224 is, in turn, coupled to one or more actuators 226, which can perform a function on the power machine. Power conversion systems in various power machines can include various components, including mechanical transmissions, hydraulic systems, and the like. The power conversion system 224 of power machine 200 includes a pair of hydrostatic drive pumps 224A and 224B, which are selectively controllable to provide a power signal to drive motors 226A and 226B. The drive motors 226A and 226B in turn are each operably coupled to axles, with drive motor 226A being coupled to axles 228A and 228B and drive motor 226B being coupled to axles 228C and 228D. The axles 228A-D are in turn coupled to tractive elements 219A-D, respectively. The drive pumps 224A and 224B can be mechanically, hydraulic, and/or electrically coupled to operator input devices to receive actuation signals for controlling the drive pumps. Although not shown in FIG. 4, some machines have a hydraulic charge pump that provides flow for various hydraulic functions, including providing makeup flow to the hydrostatic drive circuits.

The arrangement of drive pumps, motors, and axles in power machine 200 is but one example of an arrangement of these components. As discussed above, power machine 200 is a skid-steer loader and thus tractive elements on each side of the power machine are controlled together via the output of a single hydraulic pump, either through a single drive motor as in power machine 200 or with individual drive motors. Various other configurations and combinations of drive pumps and motors can be employed as may be advantageous.

The power conversion system 224 of power machine 200 also includes a hydraulic implement pump 224C, which is also operably coupled to the power source 222. The hydraulic implement pump 224C is operably coupled to work actuator circuit 238C. Work actuator circuit 238C includes lift cylinders 238 and tilt cylinders 235 as well as control logic to control actuation thereof. The control logic selectively allows, in response to operator inputs, for actuation of the lift cylinders and/or tilt cylinders. In some machines, the work actuator circuit also includes control logic to selectively provide a pressurized hydraulic fluid to an attached implement. The control logic of power machine 200 includes an open center, 3-spool valve in a series arrangement. The spools are arranged to give priority to the lift cylinders, then the tilt cylinders, and then pressurized fluid to an attached implement.

The description of power machine 100 and loader 200 above is provided for illustrative purposes, to provide illustrative environments on which the embodiments discussed below can be practiced. While the embodiments discussed can be practiced on a power machine such as is generally described by the power machine 100 shown in the block diagram of FIG. 1 and more particularly on a loader such as track loader 200, unless otherwise noted or recited, the concepts discussed below are not intended to be limited in their application to the environments specifically described above.

Figure 5:
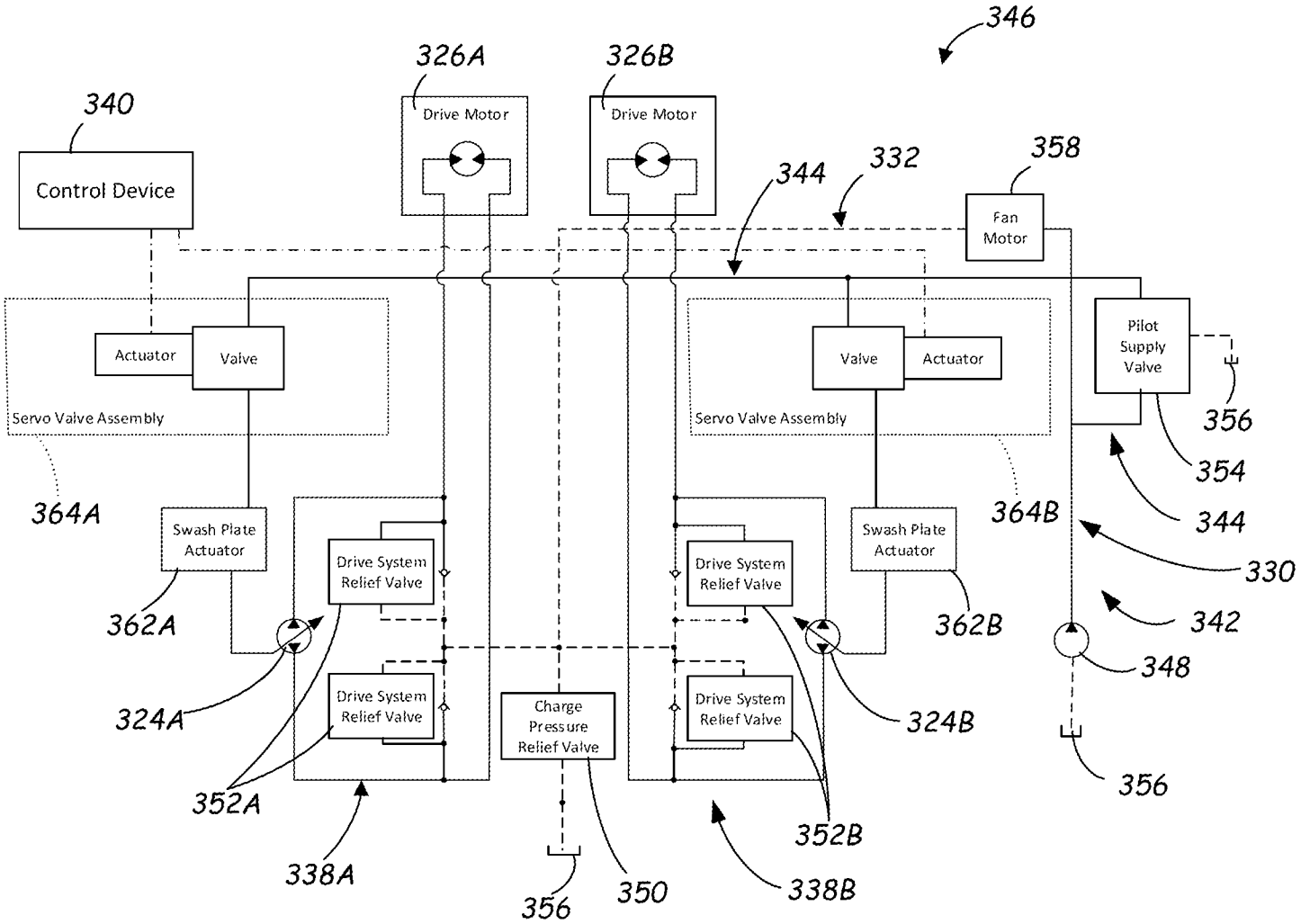
FIG. 5 is a simplified circuit diagram illustrating features of a hydrostatic drive system for a power machine, according to one of the disclosed embodiments.

FIG. 5 illustrates aspects of a hydraulic drive system that can be used for traction control of a power machine, including as a configuration for a hydraulic drive system 246 of the power machine 200 of FIGS. 2 and 3 (see, e.g., FIG. 4). As illustrated in FIG. 5, solid connecting lines indicate relatively high pressure hydraulic flow lines, dashed connecting lines represent relatively low pressure hydraulic flow lines, and dash-dot-dash lines indicate electronic signal lines. In some configurations, other connecting line arrangements are possible. For example, in some configurations, electronic control can be replaced with hydraulic control, and vice versa.

In the illustrated embodiment, the hydraulic drive system 346 includes a set of variable displacement hydrostatic drive pumps 324A, 324B, which are located within respective hydrostatic drive circuits 338A, 338B along with hydrostatic drive motors 326A, 326B. In some embodiments, the hydrostatic drive pumps 324A, 324B can be contained within a single housing, although other configurations are possible. The displacement of the drive pumps 324A, 324B can be controlled via respective swash plate actuators 362A, 3626, of any of a variety of known types, which can themselves be hydraulically actuated in order to move respective swash plates (not shown) of the drive pumps 324A, 324B. The actuators 362A, 362B in turn can be controlled via respective control valve assemblies 364A, 364B that can regulate relatively high pressure and low volume hydraulic flows and can be controlled by a control device 340. In some embodiments, the illustrated system is configured so that high pressure, low volume hydraulic flows are flows at between 20 bar and 30 bar and between 5 L/min. and 15 L/min. (inclusive), with optimal performance in some cases at 25 bar and 10 L/min.

In some embodiments, the control device 340 is an electronic device. In other embodiments, the control device can be a mechanical device, an electromechanical device, an electrohydraulic device or any other suitable device. In some embodiments, the control valve assemblies 364A and 364B are servo control valves of any variety of known configurations, although other control valves can be used in other cases.

A hydraulic charge pump 348 is arranged to pump hydraulic fluid from a reservoir 356 along a supply flow path 330 of a hydraulic charge circuit 342 that also includes a hydraulic charge flow path 332, to charge the hydrostatic drive circuits 338A, 338B. In particular, the hydraulic charge pump 348 provides an initial high pressure, high volume flow to a hydraulic load 358, which can perform work using power from the flow and thereby reduce hydraulic pressure. In some embodiments, the hydraulic load 358 can be a fan motor for thermal management of the power machine, although other hydraulic loads (or no hydraulic loads) can be provided in other cases.

Downstream of the hydraulic load 358, flow is then directed to a charge pressure relief valve 350 that establishes a predetermined minimum set pressure for supply of a charging flow to the drive circuits 338A, 338B. In the illustrated embodiment, drive system relief valves 352A, 352B are also provided, to set a maximum pressure in the hydrostatic circuits, such that high loads on a drive motor do not raise the pressure of the hydrostatic drive circuits 338A, 338B above the settings of the relief valves 352A, 352B. In some embodiments, the charge pressure relief valve 350 can set a pressure of between 5 bar and 15 bar (inclusive), with some optimal configurations having a set pressure of 10 bar.

In some embodiments, inclusion of a hydraulic load upstream of a charge pressure relief valve may be important because of the pressure drop imposed on the charge hydraulic flow by the hydraulic load. Due to this pressure drop, hydraulic pressure in a hydraulic charge circuit at a location upstream of the hydraulic load may be substantially higher (e.g., two or more times higher) than pressure at a location downstream of the hydraulic load (e.g., as set by the charge pressure relief valve). As further discussed below, this higher pressure can then be appropriately diverted for a higher pressure, lower flow signal for control of a hydrostatic drive pump.

In conventional systems, pressurized hydraulic flow for control of the displacement of the drive pumps 324A, 324B would be provided from the hydraulic charge circuit 342 downstream of the hydraulic load 358, with the pressure level being set by a relief valve included in hydrostatic pump assembly. As also discussed above, to ensure appropriately high pressure for control of the drive-pump displacement, this type of conventional configuration also would provide the same high pressure flow to the hydrostatic circuit in the form of make-up fluid. As also noted above, because pressure at a level that may be required for control of drive-pump displacement is typically substantially larger than pressure required for make-up flow into a hydrostatic circuit, this conventional arrangement can result in notable inefficiency.

In contrast, in the illustrated embodiment, hydraulic flow for control of the displacement of the drive pumps 324A, 324B branches away from the hydraulic charge circuit 342 upstream of the hydraulic load 358 (and upstream of the hydraulic charge flow path 332). In particular, pressurized flow for operation of the swash plate actuators 362A, 362B is diverted from the hydraulic charge circuit 342 along a control flow path 344. The control flow path 344 branches from hydraulic charge circuit 342 between the hydraulic load 358 and the outflow from the hydraulic charge pump 348 and routes the flow through a pilot supply valve 354 (e.g., a pressure reducing valve of a variety of known types). Accordingly, a relatively high pressure, low volume flow for the control valve assemblies 364A, 364B can be diverted from the hydraulic charge circuit 342 before the substantial pressure reduction imposed by the hydraulic load 358 (or another load, if present). Further, a relatively low pressure, high volume flow for charging the hydrostatic drive circuits 338A, 338B may continue from downstream of the hydraulic load 358.

In some embodiments, a flow for charging a hydrostatic drive circuit can be controlled to be at substantially lower pressure (i.e., at a pressure that is reduced by 50% or more) relative to a flow for control of a variable displacement drive pump. As also noted above, in some embodiments, the illustrated system is configured so that the high pressure, low volume hydraulic flows along the control flow path 344 are flows at between 20 bar and 30 bar and between 5 L/min. and 15 L/min. (inclusive), with optimal performance in some cases at about 25 bar and 10 L/min. In contrast, in some embodiments, the illustrated system is configured so that the low pressure, high volume hydraulic flows to charge the hydrostatic drive circuits 338A, 338B are flows at between 5 bar and 15 bar and between 25 L/min. and 35 L/min. (inclusive), with optimal performance in some cases at about 10 bar and 30 L/min. However, other pressures and flow rates or combinations of pressures and flow rates are possible in other embodiments.

In some embodiments, the control flow path 344 may branch from the hydraulic charge circuit 342 within the physical package of the hydraulic charge pump 348 or the pilot supply valve 354 may be within the physical package of the hydraulic charge pump 38. In some embodiments, the branch for the control flow path 344 or the pilot supply valve 354 may not be included as part of the physical package that houses the hydraulic charge pump 348 (i.e., may be external to the hydraulic charge pump).

Although a particularly useful configuration is illustrated in FIG. 5, a variety of other configurations can be used to provide similar benefits for power machines. For example, other configurations can include any variety of different types of supply valves, actuators for control of drive pump displacement, and control valve assemblies for control of those actuators. Further, although the illustrated embodiment provides unified control of flow from the hydraulic charge circuit 342 to the control valve assemblies 364A, 364B via the single control flow path 344 and the single supply valve 354, some embodiments can include separate control flow paths or separate supply valves for each relevant control valve assembly. Similarly, the details of the hydrostatic drive circuits 338A, 338B and the components along the hydraulic charge circuit 342 for charging the circuits 338A, 338B (e.g., the relief valves 352A, 352B, the relief valve 350, etc.) are provided as examples only, and the principles discussed above can be readily applied to power machines exhibiting differently arranged hydraulic drive circuits.

In some implementations, devices or systems disclosed herein can be implemented as methods embodying aspects of the invention. Correspondingly, description herein of particular features or capabilities of a device or system is generally intended to inherently include disclosure of a method of using such features for intended purposes and of implementing such capabilities. Similarly, express discussion of any method of using a particular device or system, unless otherwise indicated or limited, is intended to inherently include disclosure, as embodiments of the invention, of the utilized features and implemented capabilities of such device or system.

Figure 6:
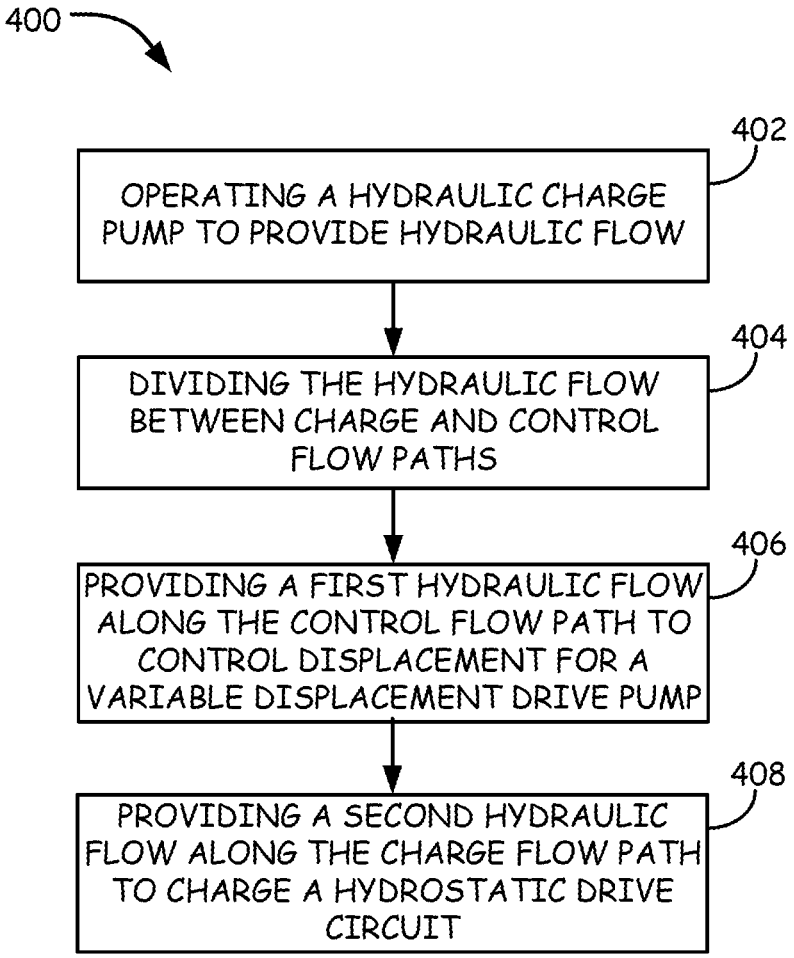
FIG. 6 is a flowchart of a process for operating a hydrostatic drive system.

In this regard, methods of operation of the hydraulic drive system 346 and of the hydraulic charge circuit 342 for various power machines has been generally described above. However, a flowchart of a process for operating a hydrostatic drive circuit of a power machine (e.g., the loader 200) has been included to provide further details for certain embodiments. For example, FIG. 6 shows an example of a flowchart of a method 400 for operating a hydrostatic drive circuit (e.g., the hydrostatic drive circuits 338A, 338B) of a hydraulic drive system (e.g., the hydraulic drive system 346) of a power machine, such as may be useful for hydraulic charging one or more hydrostatic drive circuits and controlling displacement of one or more drive pumps in communication with the hydrostatic drive circuit(s).

In particular, the method 400 can include operating 402 a hydraulic charge pump (e.g., the hydraulic charge pump 348) to provide hydraulic flow along a supply hydraulic flow path (e.g., the hydraulic flow path 342) of a hydraulic charge circuit. The method 400 can further include dividing 404 the hydraulic flow along the supply hydraulic flow path between at least two paths—e.g., a control flow path and a hydraulic charge flow path. The control flow path, which can branch away from the supply hydraulic flow path downstream of the hydraulic charge pump, is configured to control the displacement of a variable displacement drive pump. In contrast, the hydraulic charge flow path is configured to direct hydraulic flow to charge a hydrostatic drive circuit. In some cases, flow can be passively divided 404 by providing hydraulic flow lines to route flow. In some cases, flow can be more actively divided 404, including through active control of one or more valves.

As generally noted above, the method 400 can also include, via the dividing 404 of hydraulic flow from the hydraulic charge pump, providing 406 a first hydraulic flow along a first flow path to control displacement of one or more variable displacement drive pumps. For example, the provided 406 first hydraulic flow can flow along a control flow path to a control assembly (e.g., the control valve assemblies 364A, 364B) that can be configured to control displacement of a variable displacement drive pump in a variety of known ways. In other words, the properties of the first hydraulic flow (e.g., the flow rate, the pressure, etc.), as controlled by one or more relevant valve assemblies, can be used to adjust the displacement of the variable displacement drive pump (e.g., by adjusting an orientation of a swash plate). In some cases, a control flow path can include a pilot supply valve (e.g., the single supply valve 354), which can be, for example, a pressure reducing value. In some cases, the control flow path can be directed to one or more valve and actuator assemblies (e.g., the control valve assemblies 364A, 364B and the swash plate actuators 362A, 362B) for control of pump displacement.

Continuing, the method 400 can also include, via the dividing 404 of hydraulic flow from the hydraulic charge pump, providing 408 a second hydraulic flow along a second flow path to hydraulically charge one or more hydrostatic drive circuits (e.g., the hydrostatic drive circuits 338A, 338B). For example, the provided 408 second hydraulic flow can flow along a hydraulic charge flow path to one or more inlets into one or more corresponding hydrostatic drive circuits. In some cases, the hydraulic charge flow path can include a hydraulic load (e.g., a fan motor), which can provide a substantial pressure drop for of the second hydraulic flow. In some configurations, the hydraulic charge flow path can include a charge pressure relief valve (e.g., the charge pressure relief valve 350) that can regulate the pressure at which the second hydraulic flow charges the hydrostatic drive circuit.

In some embodiments, the provided 406 first hydraulic flow can have a first pressure and a first flow rate, and the provided 408 second hydraulic flow can have a second pressure and a second flow rate. For example, as also discussed above, the first pressure of the first hydraulic flow can be higher than the second pressure of the second hydraulic flow, while the first flow rate of the first hydraulic flow rate can be lower than the second flow rate of the second hydraulic flow. This difference in pressures and flow rates can provide a higher efficiency for the hydraulic drive system. For example, optimized control of pump displacement may require relatively high pressure but relatively low flow, whereas optimized hydraulic charging of a hydrostatic drive circuit may require a relatively high flow rate but a relatively low pressure. In some embodiments, the first pressure can be in a range from 20 bar to 30 bar (e.g., 25 bar), the second pressure can be in a range from 5 bar to 15 bar (e.g., 10 bar), the first flow rate can be in a range from 5 L/min. to 15 L/min. (e.g., 10 L/min.), and the second flow rate can be in a range from 25 L/min. to 35 L/min (e.g., 30 L/min.).

Although the present invention has been described by referring preferred embodiments, workers skilled in the art will recognize that changes may be made in form and detail without departing from the scope of the discussion.

What is claimed is:

1. A hydraulic charge circuit for providing pressurized hydraulic flow to a hydrostatic drive system for a power machine, the hydrostatic drive system including a hydrostatic drive circuit having a variable displacement drive pump operably coupled to a hydrostatic drive motor, and a control assembly configured to control displacement of the variable displacement drive pump, the hydraulic charge circuit comprising:

a hydraulic charge pump;

a supply hydraulic flow path extending from the hydraulic charge pump to a pressure relief valve, the pressure relief valve setting a hydraulic pressure for a charge flow of hydraulic fluid to be supplied to the hydrostatic drive circuit by the hydraulic charge pump;

a hydraulic load upstream of the pressure relief valve; and a control flow path branching from the supply hydraulic flow path upstream of the pressure relief valve, the control flow path being configured to provide a pressurized hydraulic control signal to the control assembly to control the displacement of the variable displacement drive pump.

2. The hydraulic charge circuit of claim 1, further comprising:

a supply valve in the control flow path configured to set a pressure level of the control signal.

3. The hydraulic charge circuit of claim 1, wherein the control flow path branches from the supply hydraulic flow path upstream of the hydraulic load.

4. The hydraulic charge circuit of claim 3, wherein the hydraulic load is a motor.

5. The hydraulic charge circuit of claim 3, wherein the control flow path branches from the supply hydraulic flow path downstream of and external to the hydraulic charge pump.

6. The hydraulic charge circuit of claim 1, wherein the supply hydraulic flow path includes a hydraulic charge flow path downstream of the control flow path;

wherein the hydraulic pressure in the hydraulic charge flow path is set by the pressure relief valve to be substantially lower than a hydraulic pressure in the control flow path.

7. The hydraulic charge circuit of claim 1, wherein the control flow path divides to supply pressurized hydraulic flow to multiple valve assemblies of the control assembly, for control of multiple variable displacement drive pumps.

8. A power machine comprising:

a hydrostatic drive system with a variable displacement drive pump in communication with a hydrostatic drive motor via a hydrostatic drive circuit; and a hydraulic charge circuit that includes a hydraulic charge pump, the hydraulic charge circuit being configured to provide a hydraulic charge flow to the hydrostatic drive circuit via a hydraulic charge flow path; and a control system that includes:

an actuator configured to control displacement of the variable displacement drive pump;

a valve assembly configured to control the actuator; and one or more pilot supply valves;

the one or more pilot supply valves being configured to control hydraulic flow from the hydraulic charge pump to the valve assembly along one or more control flow paths that are separate from the hydraulic charge flow path.

9. The power machine of claim 8, wherein the hydraulic charge circuit includes a hydraulic load upstream of a charge pressure relief valve and the hydrostatic drive circuit; and wherein the one or more control flow paths extend from the hydraulic charge circuit upstream of the hydraulic load.

10. The power machine of claim 9, wherein the one or more pilot supply valves are disposed along the one or more control flow paths.

11. The power machine of claim 9, wherein the one or more control flow paths extend from the hydraulic charge circuit downstream of the hydraulic charge pump.

12. The power machine of claim 8, wherein the actuator is a swash plate actuator configured to control an adjustable swash plate of the hydrostatic drive motor.

13. The power machine of claim 12, wherein the valve assembly includes a servo control valve.

14. The power machine of claim 8, further comprising:

a second variable displacement drive pump;

a second actuator configured to control displacement of the second variable displacement drive pump; and a second valve assembly configured to control the second actuator;

wherein the one or more pilot supply valves are further configured to control hydraulic flow, from the hydraulic charge pump to the second valve assembly, along the one or more control flow paths.

15. The power machine of claim 14, wherein the one or more pilot supply valves include a single pilot supply valve; and wherein the one or more flow paths includes a single control flow path from the single pilot supply valve toward the valve assembly and the second valve assembly.

16. A method of operating a hydrostatic drive circuit of a power machine, the method comprising:

operating a hydraulic charge pump to provide a hydraulic flow along a supply hydraulic flow path of a hydraulic charge circuit; and dividing the hydraulic flow, within the hydraulic charge circuit, between a hydraulic charge flow path and a control flow path that branches from the supply hydraulic flow path downstream of the hydraulic charge pump and upstream of a hydraulic load included in the hydraulic charge circuit;

wherein the control flow path provides a first flow to a control assembly that is configured to control the displacement of a variable displacement drive pump of the hydrostatic drive circuit; and wherein the hydraulic charge flow path provides a second flow to charge the hydrostatic drive circuit, and wherein the first flow is a higher pressure flow than the second flow.

17. The method of claim 16, wherein the first flow is a lower flow-rate flow than the second flow.

18. The method of claim 17, wherein the first flow is between 20 bar and 30 bar, inclusive, the second flow is between 5 bar and 15 bar, inclusive, the first flow is between 5 L/min. and 15 L/min., inclusive, and the second flow is between 25 L/min. and 35 L/min., inclusive.

19. The method of claim 16, wherein the control flow path directs the first flow to one or more valve assemblies configured to control displacements of a plurality of variable displacement drive pumps.

20. The hydraulic charge circuit of claim 1, wherein the control path branches from the supply hydraulic flow path to the control assembly.

* * * * *